US011365487B2

(12) United States Patent
Kimoto et al.

(10) Patent No.: US 11,365,487 B2
(45) Date of Patent: Jun. 21, 2022

(54) ELECTROPLATING APPARATUS

(71) Applicants: Nippon Steel Corporation, Tokyo (JP); Vallourec Oil and Gas France, Aulnoye-Aymeries (FR)

(72) Inventors: Masanari Kimoto, Tokyo (JP); Kazuya Ishii, Tokyo (JP); Masahiro Oshima, Tokyo (JP)

(73) Assignees: Nippon Steel Corporation, Tokyo (JP); Vallourec Oil and Gas France, Aulnoye-Aymeries (FR)

( * ) Notice: Subject to any disclaimer, the term of this patent is extended or adjusted under 35 U.S.C. 154(b) by 121 days.

(21) Appl. No.: 16/904,987

(22) Filed: Jun. 18, 2020

(65) Prior Publication Data

US 2020/0318250 A1 Oct. 8, 2020

Related U.S. Application Data

(62) Division of application No. 16/081,557, filed as application No. PCT/JP2017/008279 on Mar. 2, 2017, now Pat. No. 11,060,201.

(30) Foreign Application Priority Data

Mar. 3, 2016 (JP) ..... JP2016-041436

(51) Int. Cl.
*C25D 5/02* (2006.01)
*C25D 7/04* (2006.01)
(Continued)

(52) U.S. Cl.
CPC ..... *C25D 5/028* (2013.01); *C25D 5/026* (2013.01); *C25D 5/08* (2013.01); *C25D 5/611* (2020.08);
(Continued)

(58) Field of Classification Search
None
See application file for complete search history.

(56) References Cited

U.S. PATENT DOCUMENTS 4,849,084 A * 7/1989 Vouzellaud ..... C25D 7/04 204/224 R
5,580,383 A 12/1996 Ikegaya et al.
(Continued)

FOREIGN PATENT DOCUMENTS

EP 2868777 A1 5/2015
JP S609893 A 1/1985
(Continued)

OTHER PUBLICATIONS

Feb. 18, 2019 (EP) Extended European Search Report Application No. 17760129.1.

*Primary Examiner* — Louis J Rufo
(74) *Attorney, Agent, or Firm* — Banner & Witcoff, Ltd.

(57) ABSTRACT

An electroplating apparatus is provided that minimizes unplated regions when an alloy plating layer is provided on the surface of a thread on a steel pipe. An electroplating apparatus (10) includes an electrode (1), sealing members (2, 3), and a plating-solution supply unit (4). The electrode (1) faces the thread (Tm). The sealing member (2) is positioned within the steel pipe (P1). The sealing member (3) is attached to the end portion of the steel pipe (P1) and, together with the sealing member (2), forms a receiving space (8). The plating-solution supply unit (4) includes a plurality of nozzles (42). The nozzles (42) are positioned within the receiving space (8) and adjacent one end of the thread (Tm) and arranged around the pipe axis of the steel pipe (P1). The plating-solution supply unit (4) injects a plating solution between the thread (Tm) and electrode (1) through the nozzles (42). The direction in which plating solution is injected from the nozzles (42) is inclined at an
(Continued)

angle larger than 20 degrees and smaller than 90 degrees toward the thread (Tm) relative to a plane perpendicular to the pipe axis.

4 Claims, 9 Drawing Sheets

(51) Int. Cl.

| | |
|---|---|
| ***C25D 5/08*** | (2006.01) |
| ***C25D 21/10*** | (2006.01) |
| ***C25D 17/02*** | (2006.01) |
| ***C25D 5/00*** | (2006.01) |
| ***C25D 17/00*** | (2006.01) |
| ***C25D 17/12*** | (2006.01) |

(52) U.S. Cl.
CPC ..... *C25D 5/627* (2020.08); *C25D 7/04* (2013.01); *C25D 17/004* (2013.01); *C25D 17/02* (2013.01); *C25D 17/12* (2013.01); *C25D 21/10* (2013.01)

(56) References Cited

U.S. PATENT DOCUMENTS

| | | | | |
|---|---|---|---|---|
| 2015/0136590 | A1* | 5/2015 | Kimoto ..... | C25D 5/611<br>204/275.1 |
| 2016/0298251 | A1 | 10/2016 | Kimoto et al. | |

FOREIGN PATENT DOCUMENTS

| | | | | |
|---|---|---|---|---|
| JP | 5699253 | B2 | 4/2015 | |
| WO | 2014007090 | A1 | 1/2014 | |
| WO | WO-2014007090 | A1 * | 1/2014 | ..... C25D 5/08 |
| WO | 2015087551 | A1 | 6/2015 | |

* cited by examiner

ELECTROPLATING APPARATUS

RELATED APPLICATION DATA

This application is a divisional application which claims priority to U.S. patent application Ser. No. 16/081,557, filed on Aug. 31, 2018, which is a National Stage Application under 35 U.S.C. 371 of co-pending PCT application number PCT/JP2017/008279 designating the United States and filed Mar. 2, 2017; which claims the benefit of JP application number 2016-041436 and filed Mar. 3, 2016 each of which are hereby incorporated by reference in their entireties.

TECHNICAL FIELD

The present disclosure relates to an electroplating apparatus, and more particularly to an electroplating apparatus for steel pipe having a thread on the inner or outer periphery of an end thereof.

BACKGROUND OF THE INVENTION

In oil wells and natural-gas wells, oil-well pipes are used to mine underground resources. An oil-well pipe is composed of a series of steel pipes that are connected with each other. A threaded connection is used to connect such steel pipes. Threaded connections are generally categorized as coupling-type and integral-type.

A coupling-type connection uses a tubular coupling to connect steel pipes. A female thread is provided on the inner periphery of each end of the coupling. A male thread is provided on the outer periphery of each end of a steel pipe. The male thread on a steel pipe is screwed into a female thread on the coupling to connect steel pipes.

In an integral-type connection, a male thread is provided on the outer periphery of one end of a steel pipe, while a female thread is provided on the inner periphery of the other end. The male thread on one steel pipe is screwed into the female thread on another steel pipe to connect the steel pipes.

Traditionally, a lubricant is used when steel pipes are connected. Lubricant is applied to at least one of the male thread and female thread to prevent galling at the connection. Lubricants specified by the American Petroleum Institute (API) standards (hereinafter referred to as API dopes) contain heavy metals such as lead (Pb).

The use of API dopes is restricted in areas with strict environmental regulations. In such areas, lubricants containing no heavy metals (hereinafter referred to as green dopes) are used. Green dopes have lower lubricities than API dopes. Accordingly, when a green dope is used, it is desirable to provide an electroplating layer on the male thread and/or female thread to compensate for the insufficient lubricity. JP Sho60(1985)-9893 A discloses a local automatic plating apparatus for depositing an electroplating layer on a male thread.

During electroplating, air bubbles of hydrogen and/or oxygen are usually generated at the same time as an electroplating layer is deposited. If such air bubbles remain on the surface of the thread, the surface of the thread will have regions without an electroplating layer (hereinafter referred to as "unplated regions"), decreasing the galling resistance of the connection.

To address this problem, Japanese Patent No. 5699253 proposes an electroplating apparatus for depositing a uniform electroplating layer that has no unplated regions. The electroplating apparatus includes a plurality of nozzles that inject copper plating solution. The nozzles extend in a radial manner with the center at the pipe axis of the steel pipe, where the tips of the nozzles are located between the female thread and an insoluble electrode. Each nozzle has a direction of injection that crosses its direction of extension and that is circumferentially consistent with the directions of injection of the other nozzles. This generates a spiral jet stream of plating solution between the female thread and insoluble electrode, which causes small air bubbles that have been generated during electroplating to leave the thread roots. This minimizes unplated regions.

DISCLOSURE OF THE INVENTION

The electroplating apparatus of U.S. Pat. No. 5,699,253 is capable of depositing a copper plating layer, i.e. a single-metal plating layer, on the surface of a thread without producing unplated regions. However, when an alloy plating layer (e.g. zinc-nickel alloy plating layer) is to be deposited on the surface on a thread using this electroplating apparatus, plating defects that are not produced when a copper plating layer is deposited may occur, such as irregularities in appearance or small plating peels.

An object of the present disclosure is to provide an electroplating apparatus that minimizes such plating defects when depositing an alloy plating layer on the surface of a thread on a steel pipe.

An electroplating apparatus according to the present disclosure is used for a steel pipe having a thread on an inner periphery or an outer periphery of an end portion of the steel pipe. The electroplating apparatus includes a first sealing member, a second sealing member, an electrode, and a plurality of nozzles. The first sealing member is positioned within the steel pipe. The second sealing member is attached to the end portion of the steel pipe and, together with the steel pipe and the first sealing member, forms a receiving space for receiving a plating solution. The electrode is located in the receiving space and faces the thread. The plurality of nozzles are positioned within the receiving space and arranged around a pipe axis of the steel pipe for injecting a plating solution between the thread and the electrode. The plating solution is injected by each of the nozzles in a direction inclined at an angle larger than 20 degrees and smaller than 90 degrees toward the thread relative to a plane perpendicular to the pipe axis.

The present disclosure will minimize plating defects such as irregularities in appearance and small plating peels when depositing an alloy plating layer such as a zinc-nickel alloy plating layer on the surface of a thread.

EMBODIMENTS FOR CARRYING OUT THE INVENTION

Generally, if the surface of a thread on a steel pipe is electroplated, it is said to be preferable not to let plating solution directly impinge on the surface of the thread, to minimize turbulence in the liquid flow. For example, the electroplating apparatus of U.S. Pat. No. 5,699,253 is constructed to reduce the inclination of the direction of injection of plating solution toward the thread to prevent plating solution injected from the nozzles from impinging on the thread.

However, when an alloy plating layer (e.g. zinc-nickel alloy plating layer) is to be provided on the surface of the thread, an excessively small inclination of the direction of injection of plating solution can easily result in plating defects such as irregularities in appearance or small plating peels. The present inventors assumed that such plating defects result from the following circumstances during the deposition of an alloy plating layer.

Figure 1:
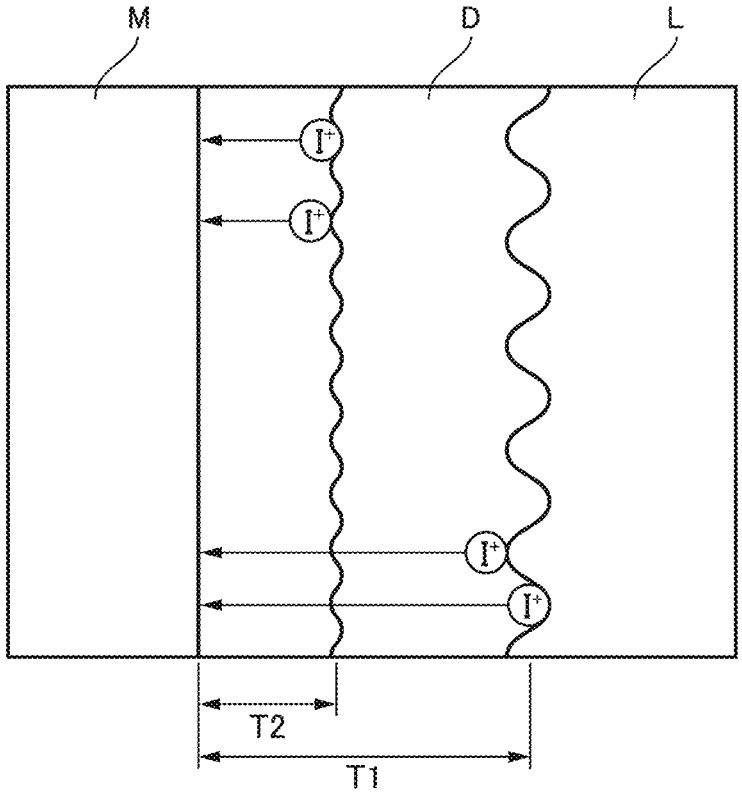
FIG. 1 is a schematic illustration of a state during electroplating.

FIG. 1 is a schematic illustration of a state during electroplating. As shown in FIG. 1, during electroplating, a diffusion layer D is generated in a plating solution L adjacent to the material M. The diffusion layer D has a concentration gradient relative to the plating solution body resulting from mass transfer due to diffusion. The rate of transfer of materials within the diffusion layer D is not affected by a stir of the plating solution L. A stir of the plating solution L affects the thickness of the diffusion layer D.

The thickness of the diffusion layer D decreases as the plating solution L is stirred more strongly. If the plating solution L is stirred gently, the thickness of the diffusion layer increases, as indicated by character T1. If the plating solution L is stirred strongly, the thickness of the diffusion layer decreases, as indicated by character T2.

Microscopically, the thickness of the diffusion layer D during electroplating is not uniform, but has fluctuations of about 10% of the average thickness measured in a state of rest. That is, the greater the thickness of the diffusion layer D, the larger the fluctuations. In the example shown in FIG. 1, the fluctuations in the thickness of the diffusion layer D occurring when the layer has an average thickness in a state of rest of T1 are larger than those occurring when the layer has an average thickness in a state of rest of T2.

Fluctuations in the thickness of the diffusion layer D affect the rate of deposition of metal on the surface of the material M. That is, metal ions $I^+$ arrive at the surface of the material M relatively early in portions of the diffusion layer D where the distance between the interface with the plating solution body and the surface of the material M is relatively short, while metal ions $I^+$ arrive at the surface of the material M relatively late in portions of the diffusion layer where the distance between the interface with the plating solution body and the surface of the material M is relatively long. This causes variations in the rate of deposition of the metal.

Such variations in the rate of deposition of metal are not particularly problematic if a plating layer of a single metal is being deposited. However, if an alloy plating layer is being deposited, variations in the rate of deposition of the metals may, for example, locally increase the amount of deposition of one metal on the surface of the material M, and therefore make the composition of the alloy plating layer deposited on the surface of the material M non-uniform. This may decrease the adherence of the alloy plating layer to the surface of the material M, causing plating peels or irregularities in the tone of color in appearance.

To make the composition of the alloy plating layer uniform, it is preferable to reduce fluctuations in the thickness of the diffusion layer D. To reduce fluctuations in the thickness of the diffusion layer D, the thickness of the diffusion layer D itself must be reduced.

Based on the above-discussed findings, the present inventors arrived at the electroplating apparatuses according to the embodiments.

An electroplating apparatus according to the present disclosure is used for a steel pipe having a thread on an inner periphery or an outer periphery of an end portion of the steel pipe. The electroplating apparatus includes a first sealing member, a second sealing member, an electrode, and a plurality of nozzles. The first sealing member is positioned within the steel pipe. The second sealing member is attached to the end portion of the steel pipe and, together with the first sealing member, forms a receiving space for receiving a plating solution. The electrode is located in the receiving space and faces the thread. The plurality of nozzles are positioned within the receiving space and arranged around a pipe axis of the steel pipe for injecting a plating solution between the thread and the electrode. The plating solution is injected by each of the nozzles in a direction inclined at an angle larger than 20 degrees and smaller than 90 degrees toward the thread relative to a plane perpendicular to the pipe axis.

An electroplating apparatus according to an embodiment is used for a steel pipe having a thread on an inner periphery or an outer periphery of an end portion. The electroplating apparatus includes a first sealing member, a second sealing member, an electrode, and a plurality of nozzles. The first sealing member is positioned within the steel pipe. The second sealing member is attached to the end portion of the steel pipe and, together with the steel pipe and the first sealing member, forms a receiving space for receiving a plating solution. The electrode is located in the receiving space and faces the thread. The plurality of nozzles are positioned in the receiving space and arranged around a pipe axis of the steel pipe for injecting a plating solution between the thread and the electrode. The plating solution is injected by each of the nozzles in a direction inclined at an angle larger than 20 degrees and smaller than 90 degrees toward the thread relative to a plane perpendicular to the pipe axis.

In the above-described electroplating apparatus, the direction of injection of the nozzles is inclined toward the thread at an angle larger than 20 degrees and smaller than 90 degrees. Thus, during electroplating, the plating solution is injected toward the thread such that the plating solution is stirred strongly near the thread. This will reduce the thickness of the diffusion layer itself, which will also reduce fluctuations therein. This will prevent variations in the rate of precipitation of the metals, resulting in a uniform composition of the alloy plating layer deposited on the surface of the thread. As a result, plating defects such as irregularities in appearance and small plating peels will be minimized.

In the above-described electroplating apparatus, the plurality of nozzles may be six or more nozzles.

Embodiments will now be described in more details with reference to the drawings. The same and corresponding elements in the drawings are labeled with the same reference characters, and their description will not be repeated. For ease of explanation, some elements may be simplified or shown schematically in the drawings, or some elements may not be shown.

First Embodiment

[Construction of Electroplating Apparatus]

Figure 2:
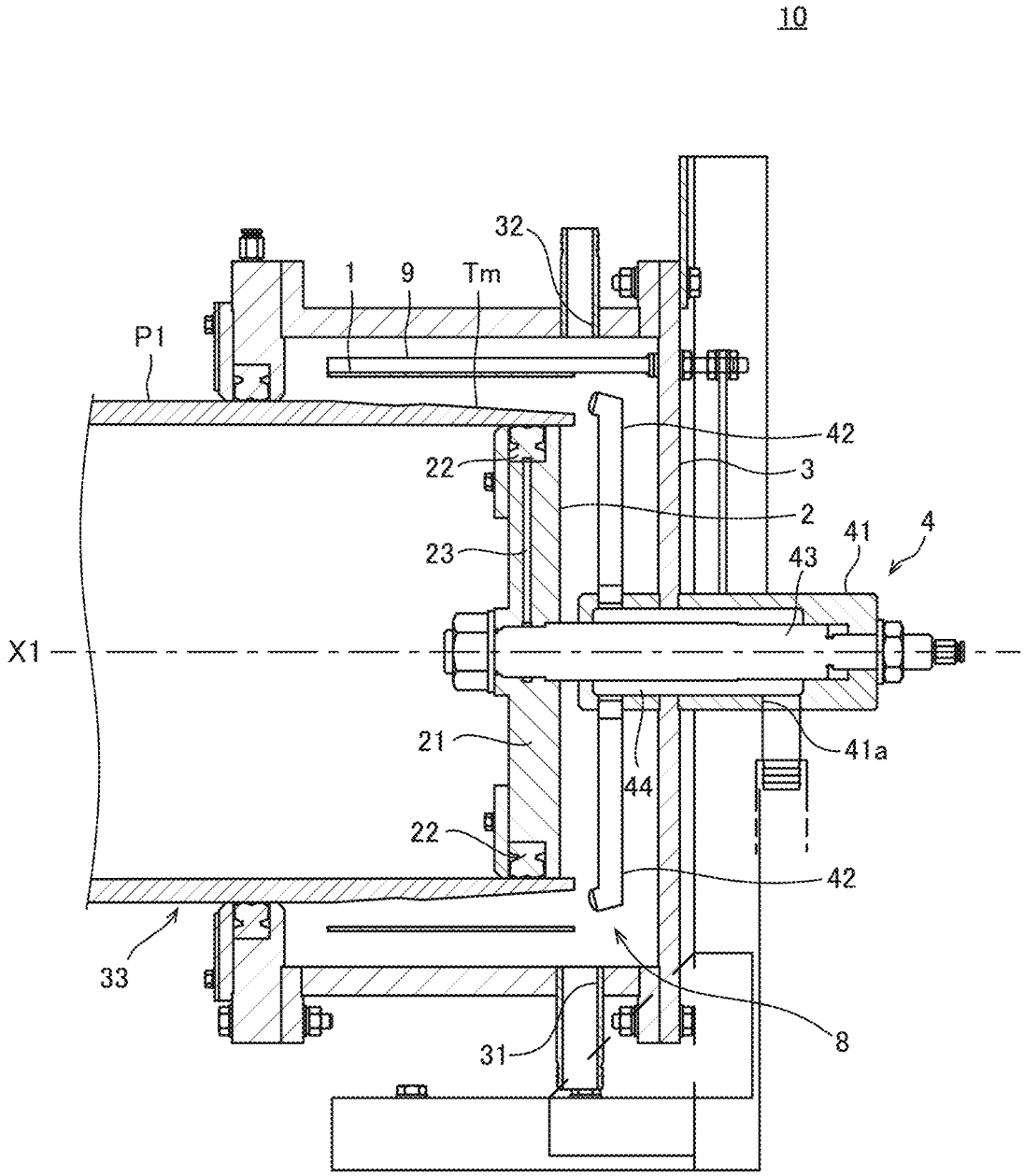
FIG. 2 is a schematic vertical cross-sectional view of an electroplating apparatus according to a first embodiment.

FIG. 2 is a schematic vertical cross-sectional view of an electroplating apparatus 10 according to a first embodiment. The electroplating apparatus 10 is used to electroplate a steel pipe P1. More specifically, the electroplating apparatus 10 deposits an alloy plating layer on the surface of a male thread Tm provided on the outer periphery of an end portion of the steel pipe P1. Generally, such an end portion of a steel pipe P1 is referred to as "pin".

As shown in FIG. 2, the electroplating apparatus 10 includes an electrode 1, a sealing member 2, a vessel 3, and a plating-solution supply unit 4.

The electrode 1 is a known insoluble anode that can be used for electroplating. The electrode 1 may be, for example, a titanium plate covered with iridium oxide or a stainless steel plate deformed to have a desired shape. The electrode 1 is not limited to a particular shape, but preferably shaped as a cylinder.

An electrically conductive rod 9 is connected to the electrode 1. The electrically conductive rod 9 may be, for example, a titanium rod or a stainless steel rod. Any number of electrically conductive rods 9 may be used; for example, three electrically conductive rods may be used.

The electrode 1 is disposed in the container 3 and adjacent the outer periphery of the steel pipe P1. In implementations where the electrode 1 is cylindrical in shape, the electrode 1 is positioned to be concentric with the steel pipe P1. The electrode 1 faces the male thread Tm on the steel pipe P1. A plating solution is supplied between the electrode 1 and male thread Tm, and a potential difference is applied between the electrode 1 and steel pipe P1 such that a plating layer is deposited on the surface of the male thread Tm.

The sealing member 2 is positioned at an end of the steel pipe P1 to seal the steel pipe P1. According to the present embodiment, the sealing member 2 is attached to an end portion inside the steel pipe P1. The sealing member 2 tightly seals the entire inner periphery of the steel pipe P1 to close the interior of the steel pipe P1. Although not limiting, the sealing member 2 may be a "hexaplug" for plumbing, for example.

The container 3 has an opening 33 for receiving the end portion of the steel pipe P1 and is used to contain plating solution, and functions as a sealing member. More specifically, the container 3 is attached to the end portion of the steel pipe P1. The container 3 is mounted on the end portion of the steel pipe P1 so as to envelop the outer periphery of the end portion of the steel pipe P1.

The container 3 is generally shaped as a cylinder having one closed end as determined along the axial direction. The end side of the container 3 supports the electrode 1 by means of the electrically conductive rod 9. The electrically conductive rod 9 is fixed to the end side of the container 3. Thus, the peripheral wall of the container 3 is disposed adjacent the outer periphery of the electrode 1.

The other end of the container 3 as determined along the axial direction tightly seals the outer peripheral surface of the steel pipe P1. The other end of the sealing member 3 as determined along the axial direction is in contact with a portion of the outer peripheral surface of the steel pipe P1 that is closer to the middle of the pipe than the male thread Tm is. Thus, the container 3, together with the steel pipe P1 and sealing member 2, forms a receiving space 8. The electrode 1 and male thread Tm are housed in the receiving space 8. The receiving space 8 is filled with a plating solution during electroplating.

The container 3 further includes orifices 31 and 32. The opening 31 is mainly used to discharge plating solution during and after plating. The opening 31 is preferably located lower than the steel pipe P1 when the container 3 is attached to the steel pipe P1.

The opening 32 is used to facilitate discharge of plating solution after plating. Discharging used plating solution quickly from the receiving space 8 prevents the alloy plating layer deposited on the male thread Tm from corroding and thus discoloring. Also, the opening 32 is used as an outlet for gas (i.e. air) when the receiving space 8 is being filled with plating solution. The opening 32 is preferably located higher than the steel pipe P1 when the sealing member 3 is attached to the steel pipe P1.

The opening 32 may be configured to be openable and closable by means of an electromagnetic valve, for example. In such implementations, the opening 32 may be opened as necessary to facilitate discharge of plating solution out of the receiving space 8. Alternatively, compressed air may be supplied to the receiving space 8 through the opening 32 to facilitate discharge of plating solution.

In some implementations, the opening 32 may have a hose connected thereto and extending upward. In such implementations, the pressure and weight of plating solution supplied to the receiving space 8 may be balanced to prevent plating solution from squirting out of the container 3.

The plating-solution supply unit 4 supplies plating solution to the receiving space 8. The plating-solution supply unit 4 includes a support member 41 and a plurality of nozzles 42.

The support member 41 is located on the side of the container 3 that is opposite to that with the opening 33 for supporting the nozzles 42. The support member 41 extends from outside the receiving space 8 through the end side of the container 3 into the receiving space 8. The support member 41 is connected to the sealing member 2 by means of fastening members. That is, the sealing member 2 is fixed to the support member 41. The support member 41 includes a channel 43 extending along the pipe axis X1 and a plating-solution channel 44 for supplying plating solution to the nozzles 42. The plating-solution channel 44 also extends along the pipe axis X1 and surrounds the channel 43. The sealing member 2 includes a disc 21 and packing 22. The disc 21 has a channel 23 extending to its outer periphery and communicating with the channel 43. The packing 22 is mounted on the outer periphery of the disc 21 and is in contact with the inner periphery of the steel pipe P1. When high-pressure air is supplied to the channel 23 through the channel 43, the packing 22 is strongly pressed against the inner periphery of the steel pipe P1.

The support member 41 includes a supply orifice 41*a*. The supply orifice 41*a* is located outside the receiving space 8. The supply orifice 41*a* is connected to a reservoir (not shown) that stores plating solution through tubing (not shown). Plating solution forwarded from the reservoir flows into the plating-solution channel 44 in the support member 41 through the supply orifice 41*a*. The plating solution is supplied to the nozzles 42 through the plating-solution channel 44.

The plating solution used for depositing the alloy plating layer may be, for example, a zinc-nickel (Zn—Ni) plating solution, a zinc-iron (Zn—Fe) plating solution, a zinc-cobalt (Zn—Co) plating solution, a nickel-tungsten (Ni—W) plating solution, or a copper-tin (Cu—Sn) plating solution. Alternatively, the plating solution may be a copper-tin-zinc (Cu—Sn—Zn) plating solution or a copper-tin-bismuth (Cu—Sn—Bi) plating solution, for example.

The nozzles 42 are connected to that end of the support member 41 which is located inside the receiving space 8. The nozzles 42, when in the receiving space 8, are arranged around the pipe axis X1 of the steel pipe P1. The nozzles 42 are disposed in a radial manner and separated by an equal distance as viewed in a pipe-axis direction.

The nozzles 42, when in the receiving space 8, are located adjacent one end of the male thread Tm. According to the present embodiment, the nozzles 42 are located between the end portion of the steel pipe P1 and the end side of the sealing member 3. The nozzles 42 inject, between the male thread Tm and electrode 1, plating solution that has been supplied from the support member 41.

Figure 3:
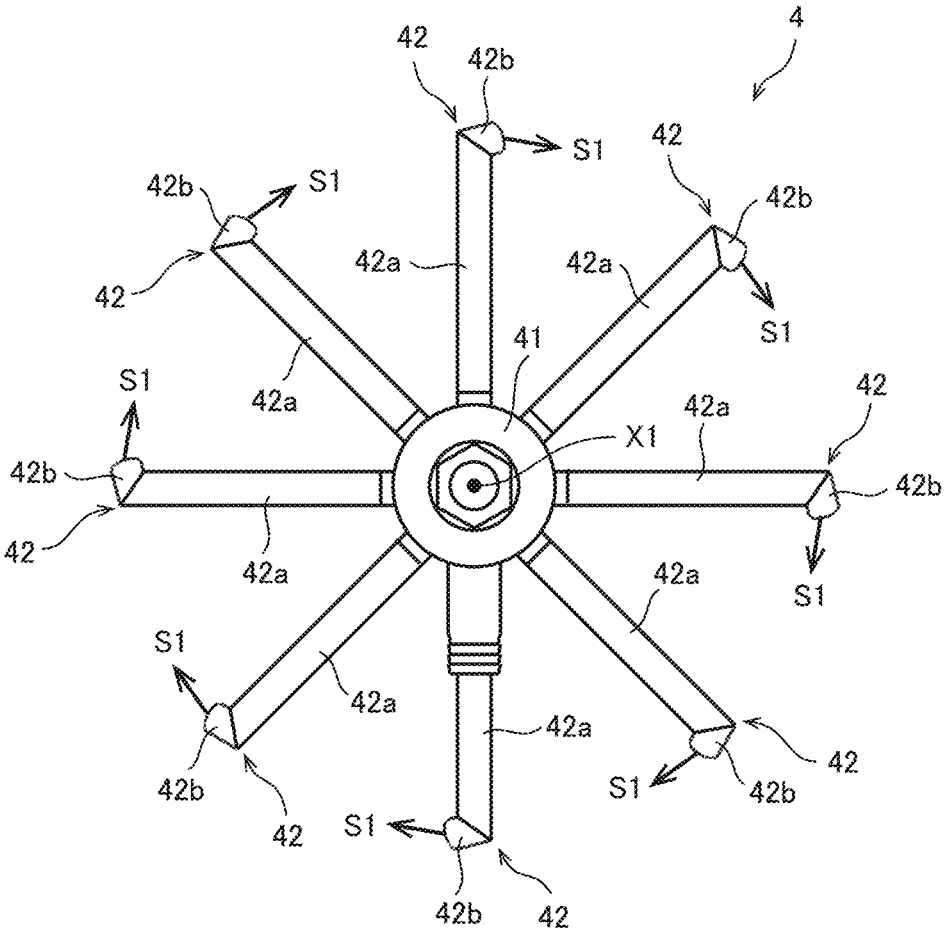
FIG. 3 is a schematic front view of the plating-solution supply unit of the electroplating apparatus shown in FIG. 1.

FIG. 3 is a schematic view of the plating-solution supply unit 4 as viewed in an axial direction of the support member 41. As shown in FIG. 3, according to the present embodiment, the plating-solution supply unit 4 includes eight nozzles 42. The number of nozzles 42 is not limited to eight, but preferably six or more nozzles are provided.

Each nozzle 42 includes a body portion 42*a* and a tip portion 42*b*. The body portion 42*a* extends substantially parallel to a plane that is perpendicular to the pipe axis X1 of the steel pipe P1. The body portion 42*a* extends radially outward from adjacent the pipe axis X1 of the steel pipe P1.

The tip portion 42*b* is contiguous to the body portion 42*a*. Plating solution passes through the body portion 42*a* and is injected through a jet orifice on the tip portion 42*b*. As viewed looking at the electroplating apparatus 10 in a pipe-axis direction of the steel pipe P1, the jet orifice on the tip portion 42*b* is positioned between the electrode 1 and male thread Tm (FIG. 2).

The nozzles 42 inject plating solution through the jet orifices on the tip portions 42*b* in one circumferential direction about the pipe axis X1. That is, the direction of injection S1 of the nozzles 42 is clockwise or counterclockwise about the pipe axis X1. Thus, the plating solution injected from the nozzles 42 forms a spiral flow with its center at the pipe axis X1. Preferably, the direction of the spiral flow formed by the nozzles 42 is the same as the thread direction of the male thread Tm (FIG. 2).

Figure 4:
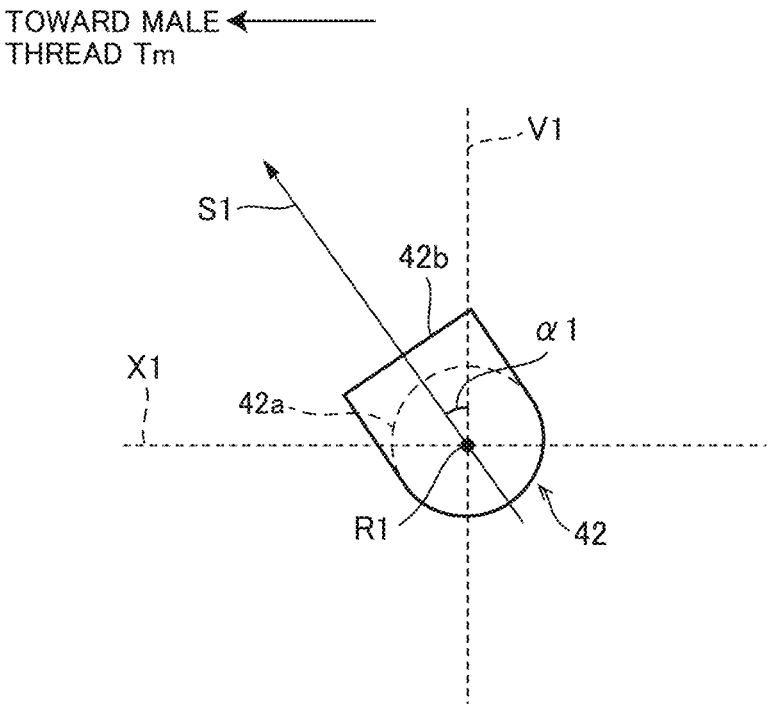
FIG. 4 is a schematic view of a nozzle of the plating-solution supply unit shown in FIG. 3 as viewed in the direction in which the body portion extends.

FIG. 4 is a schematic view of a nozzle 42 as viewed in a direction, R1, in which the body portion 42*a* extends. The tip portion 42*b* is inclined toward the male thread Tm relative to a plane that is perpendicular to the pipe axis X1 of the steel pipe P1. A direction along a plane perpendicular to the pipe axis X1, or more specifically, the direction that is perpendicular to the direction of extension R1 and the pipe axis X1, will be referred to as reference direction V1.

As shown in FIG. 4, as viewed looking at the nozzle 42 in a direction of extension R1 of its body portion 42*a*, the tip portion 42*b* is inclined at an angle of inclination $\alpha$1 toward the male thread Tm relative to the reference direction V1. That is, a direction, S1, in which the nozzle 42 injects plating solution is inclined at the angle of inclination $\alpha$1 toward the male thread Tm relative to the reference direction V1.

The angle of inclination $\alpha$1 is larger than 20 degrees and smaller than 90 degrees. More preferably, the angle of inclination $\alpha$1 is larger than 30 degrees and not larger than 60 degrees.

[Effects]

In the electroplating apparatus 10 according to the first embodiment, the direction S1 in which each nozzle 42 injects plating solution is inclined at an angle larger than 20 degrees and smaller than 90 degrees toward the male thread Tm relative to the reference direction V1. Thus, during electroplating, plating solution is injected toward the male thread Tm, thereby strongly stirring plating solution near the male thread Tm. This causes the diffusion layer produced adjacent the male thread Tm to become thinner, thereby reducing the fluctuations in the thickness of the diffusion layer. This mitigates the variations in the rate of deposition of metal, preventing the composition of the alloy plating layer deposited on the surface of the male thread Tm from being non-uniform. This minimizes plating defects such as irregularities in appearance and small plating peels.

Second Embodiment

[Construction of Electroplating Apparatus]

Figure 5:
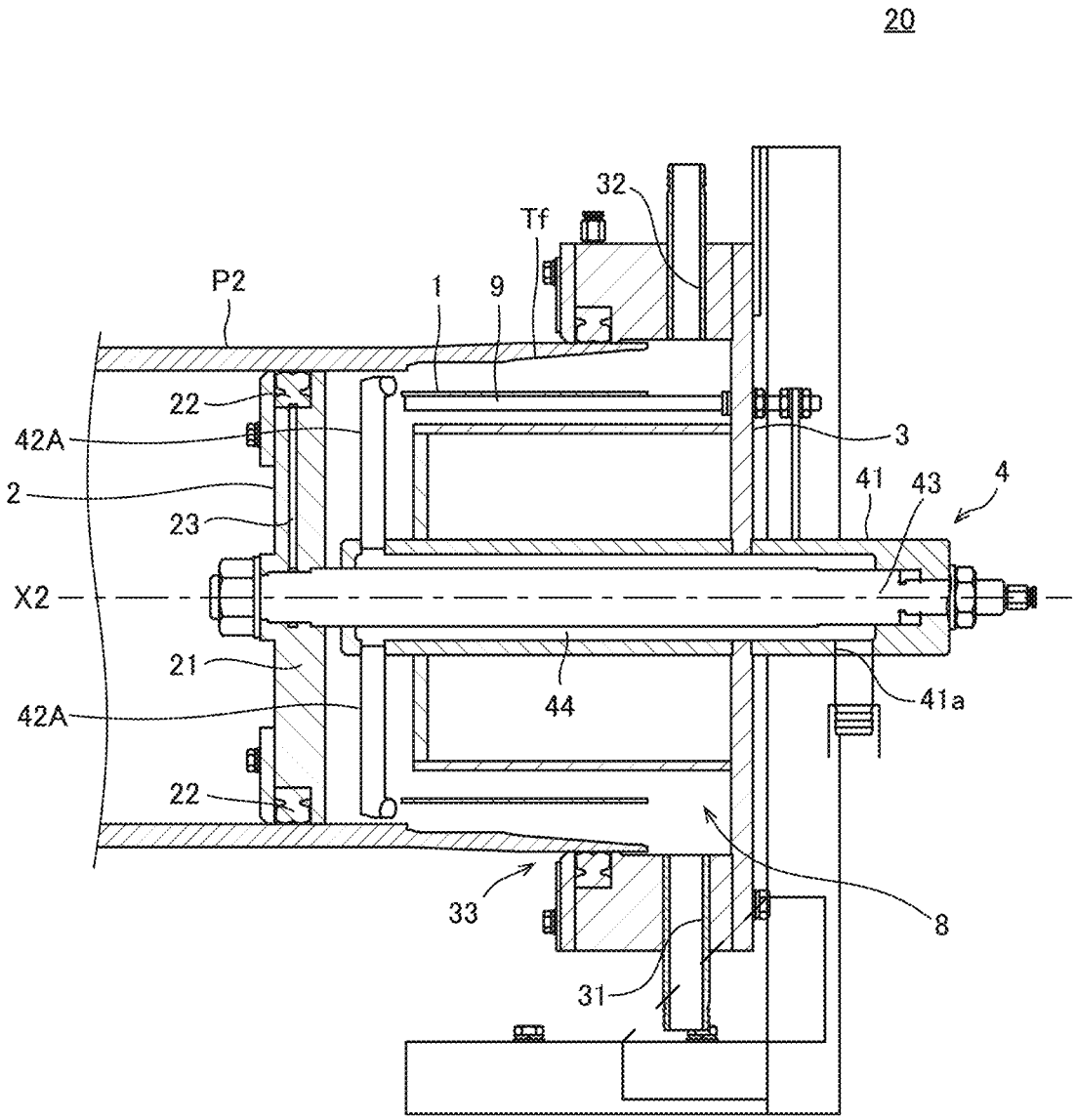
FIG. 5 is a schematic vertical cross-sectional view of an electroplating apparatus according to a second embodiment.

FIG. 5 is a schematic vertical cross-sectional view of an electroplating apparatus 20 according to a second embodiment. The electroplating apparatus 20 deposits an alloy plating layer on the surface of a female thread Tf provided on the inner periphery of an end of the steel pipe P2. Generally, such an end portion of a steel pipe P2 is referred to as "box".

As shown in FIG. 5, similar to the electroplating apparatus 10 according to the first embodiment (FIG. 2), the electroplating apparatus 20 includes an electrode 1, sealing members 2 and 3, and a plating-solution supply unit 4. However, the electroplating apparatus 20 is different from the electroplating apparatus 10 according to the first embodiment 1 in the arrangement of these elements.

The electrode 1 is located adjacent the inner periphery of the steel pipe P2. The electrode 1 faces the female thread Tf on the steel pipe P2. A plating solution is supplied between the electrode 1 and female thread Tf, and a potential difference is applied between the electrode 1 and steel pipe P2 such that a plating layer is deposited on the surface of the female thread Tf.

The sealing member 2 is located inside the steel pipe P2 and inward of the end portion to seal the steel pipe P2. Similar to that of the first embodiment, the sealing member 2 tightly seals the entire inner periphery of the steel pipe P2 to close the interior of the steel pipe P1. The sealing member 2 of the present embodiment, when in the steel pipe 2, is located closer to the middle of the pipe than the female thread Tf is.

The sealing member 3 is attached to the end portion of the steel pipe P2, similar to that of the first embodiment. However, according to the present embodiment, the location on the outer periphery of the steel pipe P2 with which the sealing member 3 is in contact is not limited to a particular location, since the female thread Tf to be electroplated is provided on the inner periphery of the steel pipe P2. The sealing member 3 may be in contact with a location on the outer periphery of the steel pipe P2 that is relatively close to the end of the steel pipe P2. In this implementation, the sealing member 3 is located at the end of the steel pipe P2 and, together with the steel pipe P2 and sealing member 2, forms a receiving space 8 for receiving plating solution. The electrode 1 is located within the receiving space 8.

The plating-solution supply unit 4 includes a plurality of nozzles 42A. The nozzles 42A are located in the receiving space 8 adjacent one end of the female thread Tf. The nozzles 42A are located between the female thread Tf and sealing member 2. That is, the nozzles 42A, when in the steel pipe P2, are located closer to the middle of the pipe than the female thread Tf is.

Figure 6:
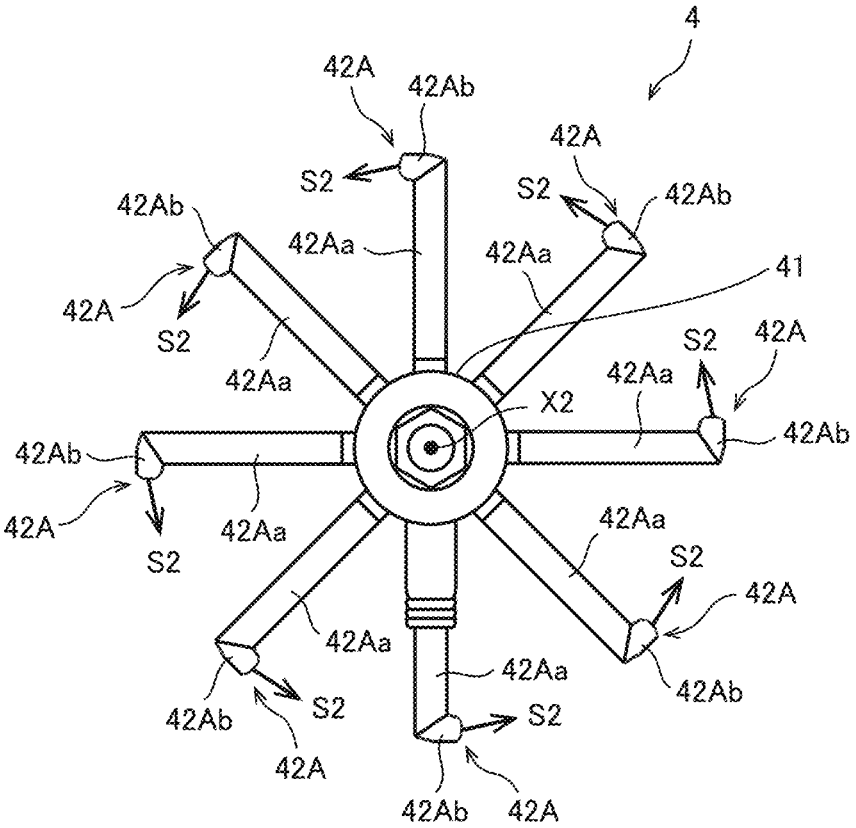
FIG. 6 is a schematic front view of the plating-solution supply unit of the electroplating apparatus shown in FIG. 5.

FIG. 6 is a schematic view of the plating-solution supply unit 4 as viewed in an axial direction of the support member 41. As shown in FIG. 6, according to the present embodiment, too, eight nozzles 42A are arranged in a radial manner and separated by an equal distance. Each nozzle 42A includes a body portion 42Aa and a tip portion 42Ab.

The body portion 42Aa extends substantially parallel to a plane that is perpendicular to the pipe axis X2 of the steel pipe P2. As viewed looking at the electroplating apparatus 20 in a pipe-axis direction of the steel pipe P2, the jet orifice on the tip portion 42Ab is positioned between the electrode 1 and female thread Tf (FIG. 5).

Similar to the nozzles 42 of the first embodiment, the nozzles 42A inject plating solution through the jet orifices on the tip portions 42Ab in one circumferential direction about the pipe axis X2. The plating solution injected from the nozzles 42A forms a spiral flow with its center at the pipe axis X2. Preferably, the direction of the spiral flow is the same as the thread direction of the female thread Tf (FIG. 5).

Figure 7:
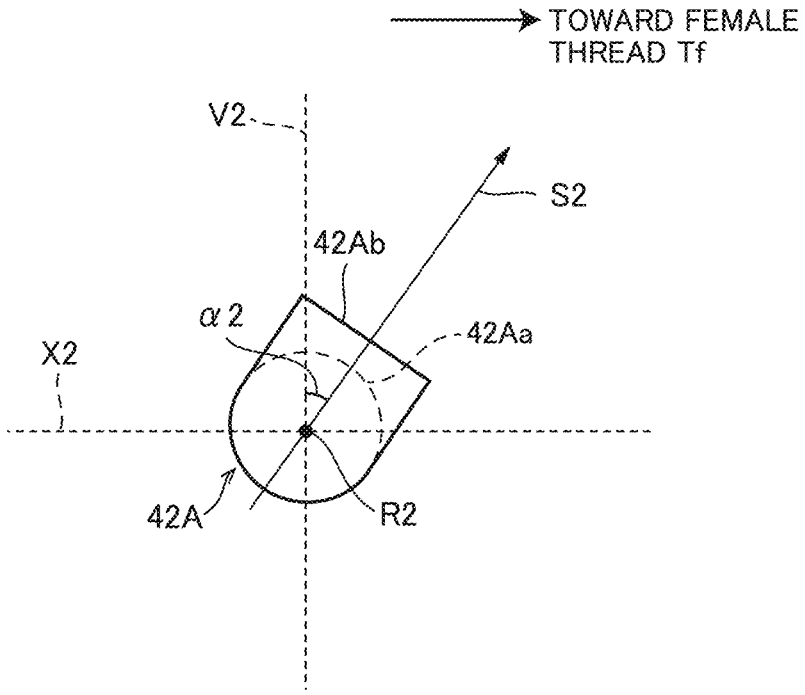
FIG. 7 is a schematic view of a nozzle of the plating-solution supply unit shown in FIG. 6 as viewed in the direction in which the body portion extends.

FIG. 7 is a schematic view of a nozzle 42A as viewed in a direction, R2, in which the body portion 42Aa extends. The tip portion 42Ab is inclined toward the female thread Tf relative to a plane that is perpendicular to the pipe axis X2 of the steel pipe P2. A direction along a plane perpendicular to the pipe axis X2, or more specifically, the direction that is perpendicular to the direction of extension R2 and the pipe axis X2, will be referred to as reference direction V2.

As shown in FIG. 7, as viewed looking at the nozzle 42A in a direction of extension R2 of its body portion 42Aa, the tip portion 42Ab is inclined at an angle of inclination a2 toward the female thread Tf relative to the reference direction V2. That is, a direction, S2, in which the nozzle 42A injects plating solution, is inclined at the angle of inclination a2 toward the female thread Tf relative to the reference direction V2. The angle of inclination a2 is larger than 20 degrees and smaller than 90 degrees, and more preferably, larger than 30 degrees and not larger than 60 degrees.

The direction S2 in which the nozzles 42A inject plating solution is inclined toward the opposite side to the direction S1 in which the nozzles 42 of the first embodiment inject plating solution. This is because the nozzles 42A of the second embodiment are positioned in an opposite manner to the nozzles 42 of the first embodiment across a pipe section extending in the pipe-axis direction.

Toward which side the direction of injection of plating solution is to be inclined may be determined depending on the relative positional relationship between the thread and nozzles. In short, the direction of injection of the nozzles is only required to be inclined toward the thread relative to a plane that is perpendicular to the axial direction of the steel pipe such that plating solution is injected toward the thread.

[Effects]

In the electroplating apparatus 20 according to the second embodiment, the direction S2 in which each nozzle 42A injects solution is inclined at an angle larger than 20 degrees and smaller than 90 degrees toward the female thread Tf relative to the reference direction V2. Thus, during electroplating, plating solution near the female thread Tf is strongly stirred. This causes the diffusion layer to become thinner, thereby reducing the fluctuations in the thickness of the diffusion layer. This prevents the composition of the alloy plating layer deposited on the surface of the female thread Tf from being non-uniform. This minimizes plating defects such as irregularities in appearance and small plating peels.

<Variations>

Although some particular embodiments have been described, the present disclosure is not limited to the above-illustrated embodiments, and various modifications are possible without departing from the spirit of the disclosure.

In the above-illustrated embodiments, the body portions of the nozzles extend parallel to a plane that is perpendicular to the pipe axis of the steel pipe, and the tip portions of the nozzles are inclined relative to this plane; however, the present disclosure is not limited to such a configuration. For example, the entire nozzles may be inclined relative to a plane that is perpendicular to the pipe axis of the steel pipe to inject plating solution at a predetermined angle.

In the above-illustrated embodiments, the sealing member inside the steel pipe is fixed to the support member of the plating-solution supply unit by means of fastening members. Alternatively, the sealing member may not be fixed to the plating-solution supply unit.

EXAMPLES

The effects of the present disclosure will be illustrated below with reference to examples. However, the present disclosure is not limited to the examples illustrated below.

A degreasing liquid (50 g/L of sodium hydroxide), Ni strike bath (250 g/L of nickel chloride, 80 g/L of hydrochloric acid), Zn—Ni plating bath ("Dain Zinalloy" from Daiwa Fine Chemicals Co., Ltd.) were prepared, and the electroplating apparatus (10) shown in FIG. 1 was used to perform Zn—Ni alloy plating (Ni content (target): 12 to 16%) on the surface of a male thread (Tm) on a steel pipe (P1). The steps of the electroplating process and their conditions are shown in Table 1.

TABLE 1

| | Cathode electrolytic degreasing | | | Ni strike | | | Zn—Ni plating | | |
|---|---|---|---|---|---|---|---|---|---|
| Step | Bath temperature (° C.) | Current density (A/dm$^2$) | Process time (sec.) | Bath temperature (° C.) | Current density (A/dm$^2$) | Process time (sec.) | Bath temperature (° C.) | Current density (A/dm$^2$) | Process time (sec.) |
| Process conditions | 50 | 6 | 60 | 35 | 6 | 120 | 25 | 2 | 1080 |

Plating was performed with different angles of inclination (α1) of the direction of injection (S1) by the nozzles (42) and with different numbers of nozzles (42), and it was investigated whether there were plating peels. The presence of plating peels was visually evaluated using a three-grade scale: "Good" means that there were no unplated regions; "Normal" means that there were small unplated regions; and "Bad" means that there were large unplated regions. The results of investigation are shown in Table 2.

TABLE 2

| Category | Nozzle angle α1 (°) | Number of nozzles | Plating peels | Tone of color L value | Tone of color Uniformity |
|---|---|---|---|---|---|
| Comp. ex. | 20 | 8 | Bad | 76 | Irregular |
| Inv. ex. 1 | 45 | 3 | Normal | 80.3 | Uniform |
| Inv. ex. 2 | 35 | 8 | Good | 81.1 | Uniform |
| Inv. ex. 3 | 45 | 6 | Good | 80.7 | Uniform |
| Inv. ex. 4 | 60 | 8 | Good | 79.5 | Uniform |

As shown in Table 2, the comparative example with an angle of inclination (α1) of 20 degrees had a large numbers of plating peels. On the other hand, inventive examples 1 to 4, which had angles of inclination (α1) larger than 20 degrees, had only limited numbers of plating peels compared with those of the comparative example. Particularly, inventive examples 2 to 4, which had six or more nozzles (42), had no plating peels at all.

Figure 9:
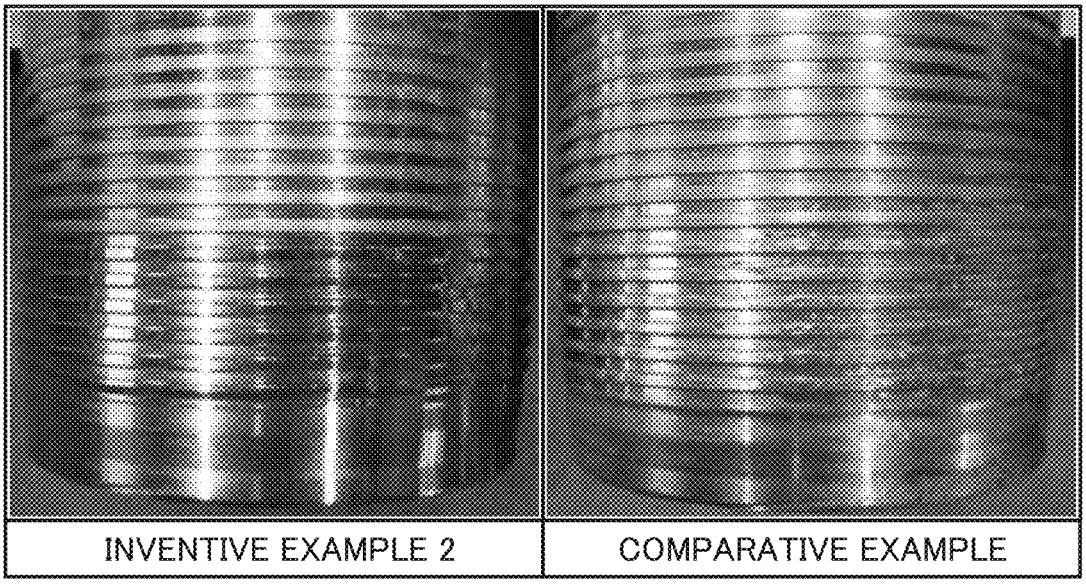
FIG. 9 shows pictures for comparison between a steel pipe of an inventive example and a steel pipe of a comparative example.

FIG. 9 shows pictures for comparison between the steel (P1) of inventive example 2 and the steel (P1) of the comparative example. FIG. 9 shows that the steel pipe (P1) of inventive example 2 had no plating peels, while the steel pipe (P1) of the comparative example had a large number of plating peels.

Further, regarding the brightness of color of the plating, as shown in Table 2, inventive examples 1 to 4 had L values of 79.5 to 81.1, which means substantially uniform silver white, while the comparative example had an L value of 76, which means a relatively dark tone, and, as a whole, had irregularities with relatively dark portions mixed into the silver-white portion.

Figure 8:
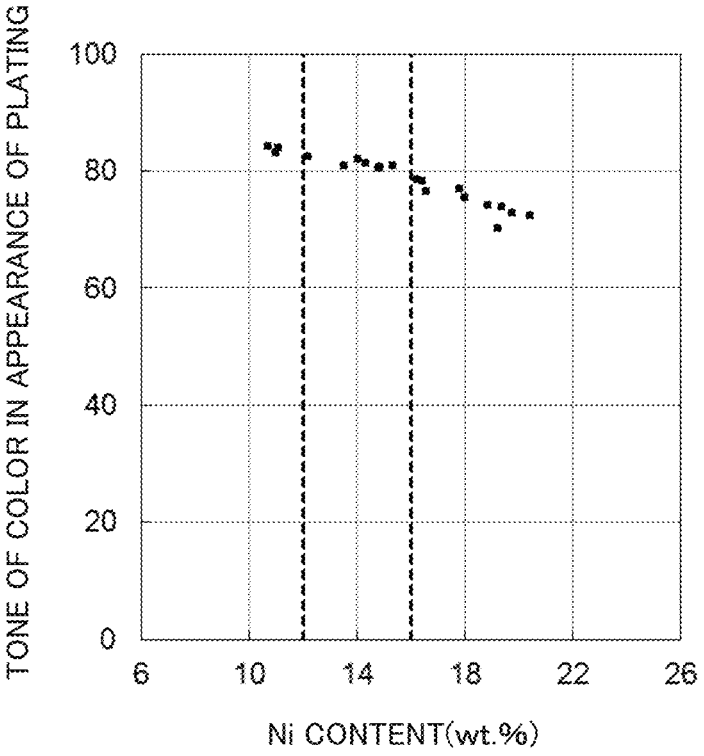
FIG. 8 is a graph showing the relationship between the composition (Ni content) and brightness of color (L value) of the Zn—Ni alloy plating layer.

FIG. 8 shows the relationship between the composition (Ni content) and brightness of color (L value) of the Zn—Ni alloy plating layer. When the Ni content is in the range of 12 to 16 wt. %, the L value is in the range of 78 to 83, meaning that the tone of color is silver white. When the Ni content is still higher, the L value becomes lower, which means a relatively dark tone of color. That is, it can be concluded that, in each of inventive examples 1 to 4, the composition of the alloy plating layer was in the range of target composition of the present examples and was substantially uniform. On the other hand, it can be concluded that, in the comparative example, portions with higher Ni contents were locally present and the composition of the alloy plating layer was not uniform.

The inventive and comparative examples demonstrate that inclining the direction in which the nozzles inject plating solution at an angle larger than 20 degrees and smaller than 90 degrees toward the thread relative to a plane that is perpendicular to the pipe axis of the steel pipe will minimize plating defects left after the deposition of an alloy plating layer. The inventive and comparative examples also demonstrate that having six or more nozzles will further improve the effect of minimizing plating defects.

The invention claimed is:

1. An electroplating apparatus used for a steel pipe having a female thread on an inner periphery of an end portion of the steel pipe, the electroplating apparatus comprising:

a first sealing member positioned within the steel pipe and inward of the end portion to seal the steel pipe;

a second sealing member positioned at an end of the steel pipe and, together with the steel pipe and the first sealing member, form a receiving space for receiving a plating solution;

an electrode located in the receiving space and facing the female thread; and a plurality of nozzles positioned within the receiving space and arranged around a pipe axis of the steel pipe for injecting a plating solution between the female thread and the electrode, and a support member provided on the second sealing member to support the plurality of nozzles, wherein the plating solution is injected by each of the nozzles in a direction inclined at an angle larger than 20 degrees and smaller than 90 degrees toward the female thread relative to a plane perpendicular to the pipe axis, wherein the support member includes a plating-solution channel for supplying the plating solution to the nozzles, and the first sealing member is fixed to the support member, and wherein the nozzles are located between the female thread and the first sealing member.

2. The electroplating apparatus according to claim 1, wherein the support member includes a first channel extending along the pipe axis, and wherein the first sealing member includes:

a disc including a second channel extending to an outer periphery thereof and communicating with the first channel; and packing mounted on the outer periphery of the disc and in contact with an inner periphery of the steel pipe.

3. The electroplating apparatus according to claim 1, wherein the number of the nozzles is six or larger.

4. The electroplating apparatus according to claim 2, wherein the number of the nozzles is six or larger.

* * * * *